US006373182B1

(12) United States Patent
Kloba et al.

(10) Patent No.: US 6,373,182 B1
(45) Date of Patent: Apr. 16, 2002

(54) MOUNTING FOR CATHODE IN AN ELECTRON GUN

(75) Inventors: Anthony A. Kloba; Randolph D. Schueller, both of Austin; David A. Delguzzi, Pflugerville; Donald E. Patterson, Pearland; Keith D. Jamison; Kent R. Kalar, both of Austin, all of TX (US)

(73) Assignee: Extreme Devices, Inc., Austin, TX (US)

( * ) Notice: Subject to any disclaimer, the term of this patent is extended or adjusted under 35 U.S.C. 154(b) by 0 days.

(21) Appl. No.: 09/534,374

(22) Filed: Mar. 24, 2000

(51) Int. Cl.[7] ..... H01J 29/48
(52) U.S. Cl. ..... 313/446; 313/447; 313/309
(58) Field of Search ..... 313/446, 452, 313/441, 447, 443, 444, 451, 270, 309; 445/34

(56) References Cited

U.S. PATENT DOCUMENTS 4,687,964 A 8/1987 Ebihara et al.
5,877,594 A 3/1999 Miyano et al.

FOREIGN PATENT DOCUMENTS

| | | |
|---|---|---|
| DE | 197 03 238 A1 | 7/1997 |
| DE | 197 28 679 A1 | 1/1998 |
| EP | 0 772 218 A2 | 5/1997 |
| EP | 0 944 107 A2 | 9/1999 |

OTHER PUBLICATIONS

Patterson, D. E. et al., "Advanced CVD Diamond Microtip Devices for Extreme Applications," Materials Research Society Symposium Proceedings, vol. 509, pp. 65–75, XP001006112 (1998).

D.E. Patterson, et al., *Advanced CVD Diamond Microtip Devices for Extreme Applications*, Mat. Res. Soc. Symp. Proc. vol. 59 (1998).

*Primary Examiner*—Nimeshkumar D. Patel
*Assistant Examiner*—Thelma Sheree Clove
(74) *Attorney, Agent, or Firm*—Baker Botts L.L.P.

(57) ABSTRACT

Apparatus and method for mounting a field emission device having emitters and an extraction grid in an electron gun are provided. The apparatus may be adapted from parts of a conventional electron gun that uses a thermionic emitter. Electrical connection to the grid is provided by bumps that are spring-loaded against a conducting surface, such as the second grid of a conventional electron gun.

13 Claims, 5 Drawing Sheets

MOUNTING FOR CATHODE IN AN ELECTRON GUN

BACKGROUND OF THE INVENTION

1. Field of the Invention

This invention pertains to electron guns for devices such as cathode ray tubes (CRTs). More particularly, apparatus and method that may use modified parts of conventional electron guns are provided for mounting field emission devices.

2. Description of Related Art

A conventional electron gun uses a thermionic emitter as the source of electrons. FIG. 1 illustrates a common configuration of the lower parts of an electron gun using a thermionic emitter. Parts of an electron gun having a cathode and two grids are generally shown at 10. Both grids, along with other grids, are normally "beaded" into a structure that makes up the entire electron gun. Filament 12 is used to heat emissive coating 14 to cause electron emission. Cathode cap 16, attached to cathode shank 18, supports emissive coating 14 (usually a combination of one or more of barium, strontium or calcium carbonates, which are converted to oxides in a CRT). Cathode shank 18 is normally welded to interface ring 20. Interface ring 20 may be formed integral in ceramic cathode mount 22. Ceramic cathode mount 22 is free to slide in grid 24 but is fastened in place by welding during final electron gun assembly. Grid 24 (G1) and Grid 26 (G2) are used to focus and accelerate the electrons produced by emissive coating 14. The grids are biased electrically in a way to create a source of electrons that can be further focused and modulated by other grids to satisfy CRT requirements.

The technology to allow replacement of cathodes based on thermionic emission with cold cathodes based on field emission of electrons (Field Emission Devices or FEDs) has been developing in recent years. The emission of electrons from cold cathodes may occur from microtips that are fabricated from molybdenum, silicon or, in very recent years, carbon-based materials. It has been demonstrated that the carbon-based material or diamond-like material can be monolithically integrated with gated electrodes in a self-aligned structure, using integrated circuit fabrication techniques ("Advanced CVD Diamond Microtip Devices for Extreme Applications," MAT. RES. SOC. SYMP. PROC., Vol. 509 (1998)). The use of field emission devices with the extraction gate built-in eliminates the need for two of the electrodes in an electron gun built on thermionic emission, G1 and G2 of FIG. 1 Elimination of these electrodes simplifies the gun and also reduces its length. The application of the integrated carbon-like cathode and electrodes into an electron gun has been described in a pending and commonly assigned patent application entitled "Compact Field Emission Electron Gun and Focus Lens," filed Jul. 19, 1999, Ser. No. 09/356,851, with named inventors Rich Gorski and Keith D. Jamison, which is incorporated herein by reference. A segmented cathode has been disclosed in pending and commonly assigned patent application "Segmented Gate Drive for Dynamic Beam Correction in Field Emission Cathodes," filed Dec. 31, 19999, Ser. No. 09/476,051, with named inventors Keith D. Jamison and Donald E. Patterson, which is incorporated herein by reference. A package structure for mounting a field emitting cathode into an electron gun is described in a pending and commonly assigned patent application entitled "Package Structure for Mounting a Field Emitting Device in an Electron Gun", filed Jan. 28, 2000, Ser. No. 09/493,379, with named inventors Randolph D. Schueller, Kent R. Kalar and Anthony A. Kloba, which is incorporated herein by reference.

Structures for incorporating field emission cathodes into an electron gun are known. but these structures require either considerable re-engineering or replacement of the parts of electron guns using thermionic emitters or newly designed parts. The electron gun design changes and gun part tool modifications are both costly and time-consuming. The use of field emission devices (FEDs) as cathodes is new in the cathode ray tube (CRT) industry and demonstration of their benefits in a CRT using prior methods or apparatus would require costly and time-consuming electron gun design changes. Once the advantages of FEDs are demonstrated, these changes are expected to prove well worth the expense. What is needed is a structure and method that require minimal modification of the parts of already commercial electron guns that use thermionic emission, i.e., that do not require extensive gun design and part tooling changes, while serving all the requirements of FEDs. Use of the structure in a CRT should also allow minimum changes in electrical connections to the CRT.

BRIEF SUMMARY OF THE INVENTION

An electron gun structure for use of a field emission cathode having an integral extraction grid is provided. The structure includes a spring confined in a hollow member, which may be the grid (G1) of a conventional electron gun, that acts on a shank, which may be the cathode shank of a conventional electron gun, to press an electrical contact area around an emitting array against a second surface, which may be the grid (G2) of a conventional electron gun. The electrical contact area is electrically connected to the extraction grid of a field emission array. The grid may be integrally formed with the emitters of the array. The field emitting array is formed on a substrate and is preferably carbon-based. In another embodiment, a support plate is placed beneath the substrate to increase the mechanical contact area between the cathode cap and the FED substrate. In yet another embodiment, the cathode shank is cut off, which may reduce angular mounting errors in some applications.

DESCRIPTION OF THE DRAWINGS

For a more complete understanding of the present invention and the advantages thereof, reference is now made to the following description taken in conjunction with the following drawings in which like reference numbers indicate like features and wherein.

DETAILED DESCRIPTION OF THE INVENTION

Figure 2:
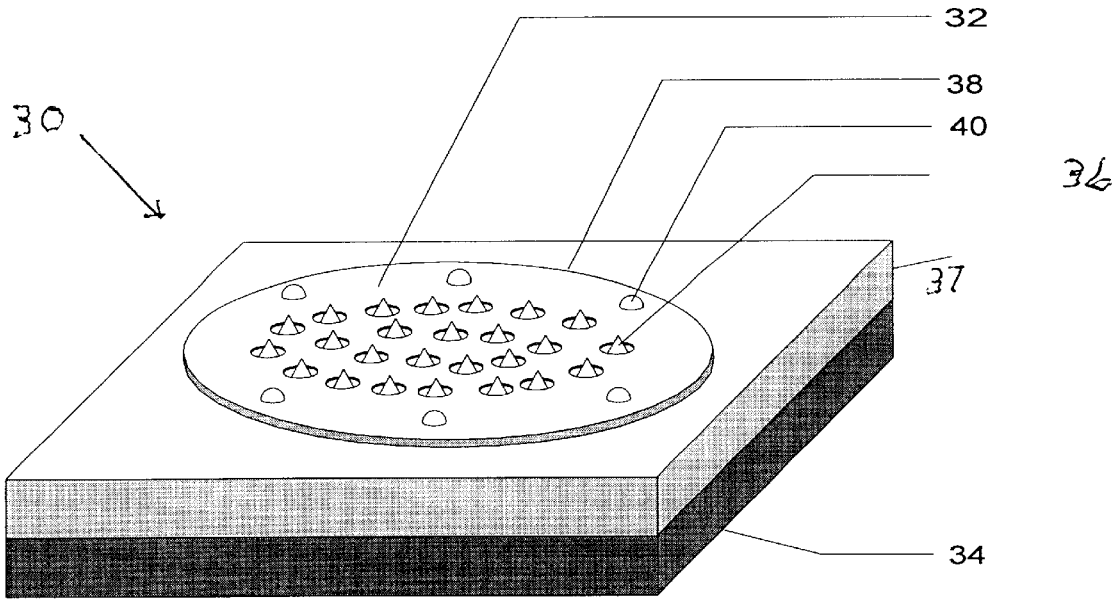
FIG. 2 shows a cathode including a field emission array suitable for use in an electron gun.

Referring to FIG. 2, a view of a cathode is shown generally at 30. Field emission array 32 has been formed on substrate 34. The field emission array may be carbon-based as disclosed in commonly assigned pending patent applications Ser. Nos. 09/169,908 and 09/169,909, filed Oct. 12, 1998; Ser. No. 09/356,856, filed Jul. 19, 1999; Ser. No. 09/476,651, filed Dec. 31, 1999 and Ser. No. 09/493,379, filed Jan. 28, 2000, all of which are incorporated herein by reference. The array is preferably formed with carbon-based emitters 36 and integrally formed gate layer 38. Bumps 40, which may be gold stud bumps, may be formed on gate contact layer 38, the bumps to serve as electrical contact sites as well as mechanical standoffs to prevent shorting of the edge of the substrate when mounting procedures explained below are used. Insulating layer 37 separates gate layer 38 from emitters 36.

Figure 1:
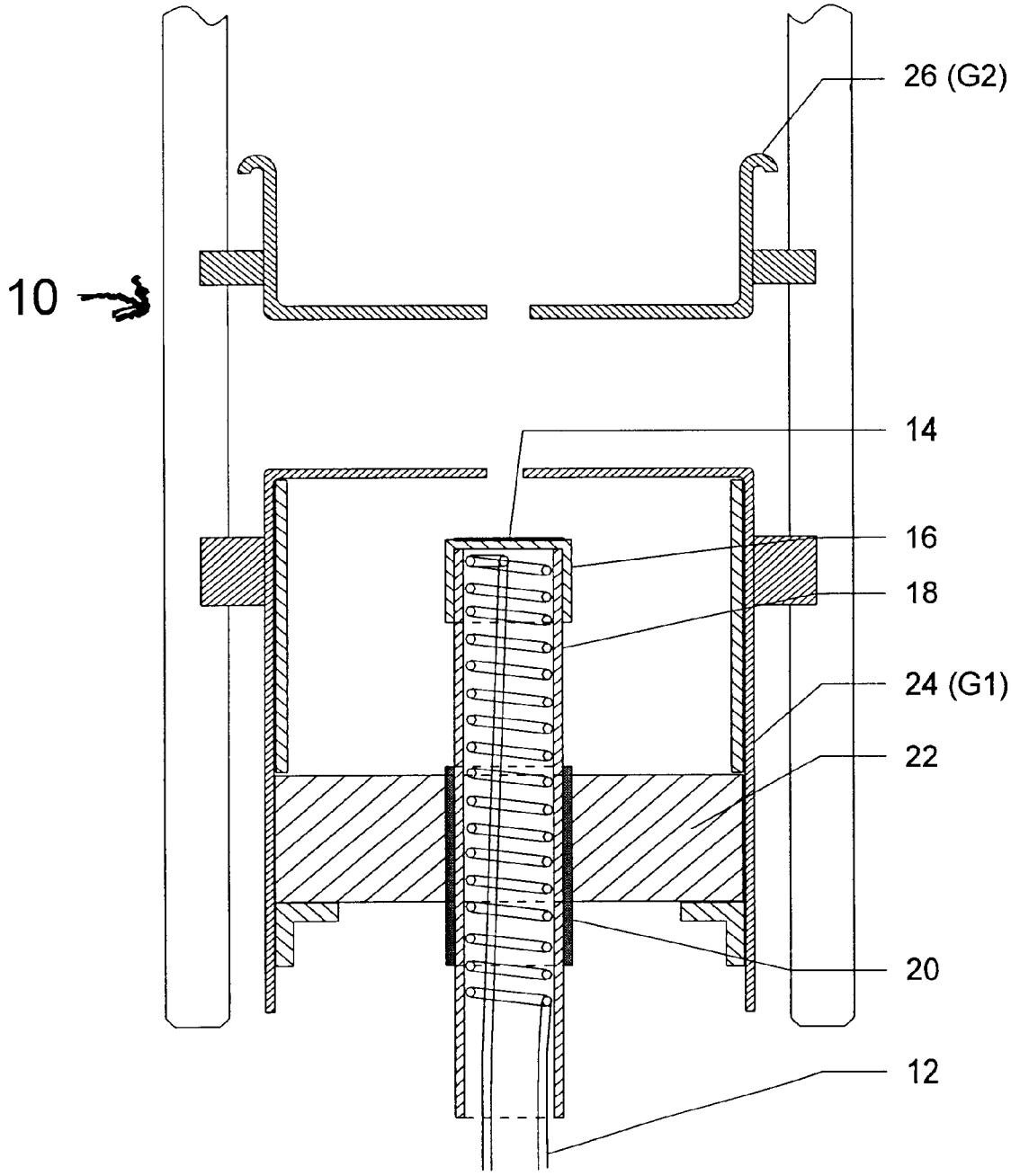
Prior Art Figure 1
FIG. 1 shows a configuration of the lower parts of a prior art electron gun using a thermionic emitter.
Figure 3:
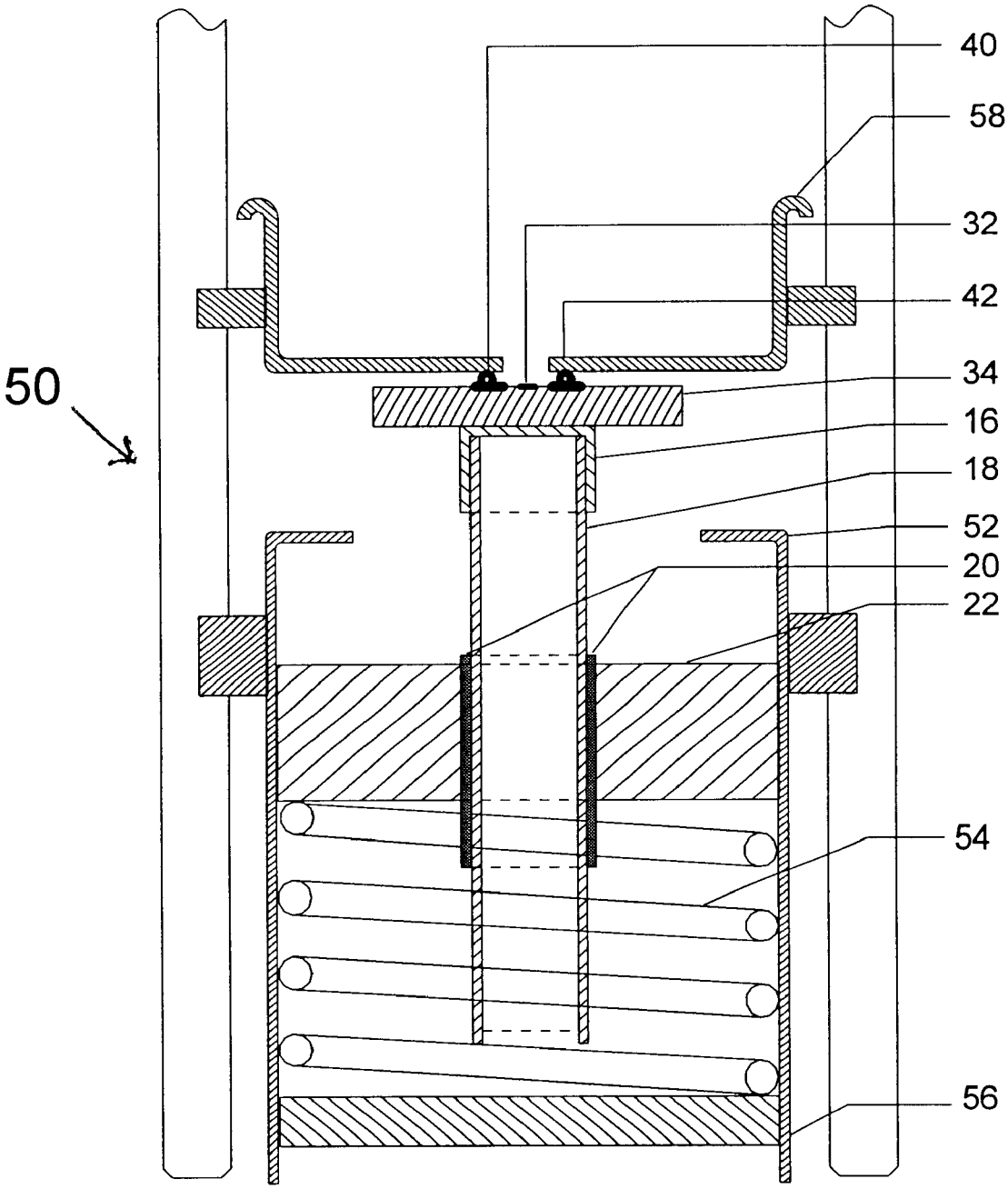
FIG. 3 shows one embodiment of an electron gun using a field emitting cathode.

Referring to FIG. 3, parts of an electron gun using thermionic emission such as shown in FIG. 1 have been modified to provide an electron gun for use with FEDs, shown generally at 50. Parts are "beaded" together using conventional techniques. The emissive coating 14 of FIG. 1 has been removed or omitted from cathode cap 16 and field emission array substrate 34 is bonded to cathode cap 16 so as to form electrical contact between cap 16 and field emission array 32. A conductive graphite coating or "Aquadag" or a high-temperature conductive adhesive such as ABLEBOND 71-1 or ABLEBOND 2106 may provide the adhesive, electrical, high-temperature and high-vacuum properties required for CRT manufacturing. The aperture of grid 24 (G1) of FIG. 1 has been enlarged to form cylinder 52, which allows clear passage of joined substrate 34 through the aperture. Of course, any suitably sized hollow member may be used for cylinder 52. Cathode shank 18 is welded to interface ring 20 before insertion of the assembly into cylinder 52. Ceramic cathode mount 22 is placed in cylinder 52, then coil spring 54 is inserted into cylinder 52 and retaining spring disk 56 is inserted and fastened (preferably by welding) in cylinder 52. Coil spring 54, held in place by retainer 56, serves to press bumps 40 against cylinder 58 with a force to make electrical contact with gate layer contact 42, shown in FIG. 2. The modified electron gun is then formed from the parts shown in FIG. 3 and any other grids that may be needed. The modified gun can be sealed into a CRT using conventional techniques.

Figure 4:
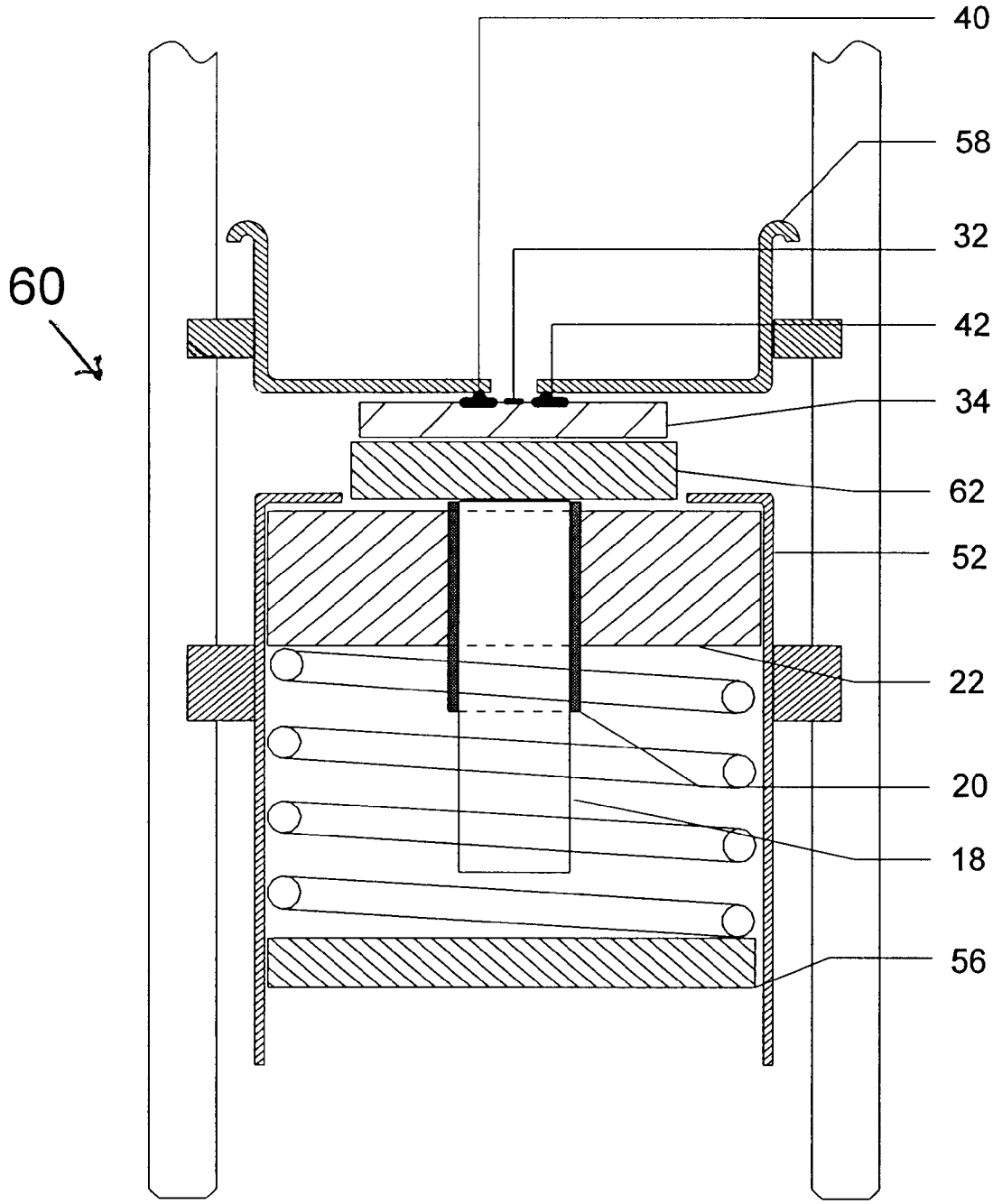
FIG. 4 shows a second embodiment of an electron gun using a field emitting cathode.

FIG. 4 shows a second embodiment of an electron gun adapted for use with FED cathodes. In this embodiment, shown generally at 60, the top of cathode shank 18 and cathode cap 16 of FIG. 1 have been cut off level with the top surface of ceramic cathode mount 22. Metal support plate 62 (preferably nickel or stainless steel) may be spot welded to the exposed end of metal-to-ceramic interface cylinder 20. Support plate 62 can also be bonded to the top of ceramic cathode mount 22 using a conductive graphite coating or "Aquadag" or a high-temperature conductive adhesive such as ABLEBOND 171-1 or ABLEBOND 2106. This provides mechanical attachment of support plate 62 to ceramic cathode mount 22 and provides electrical connection of support plate 62 to metal-ceramic interface ring 20 and cathode shank 18. Field emission substrate 34 may be bonded to metal support plate 62 using the adhesives previously mentioned. Electrical contact is thus established between support plate 62 and field emission array 32 and cathode shank 18. The support plate is used in some applications to increase the electrical contact area.

Figure 5:
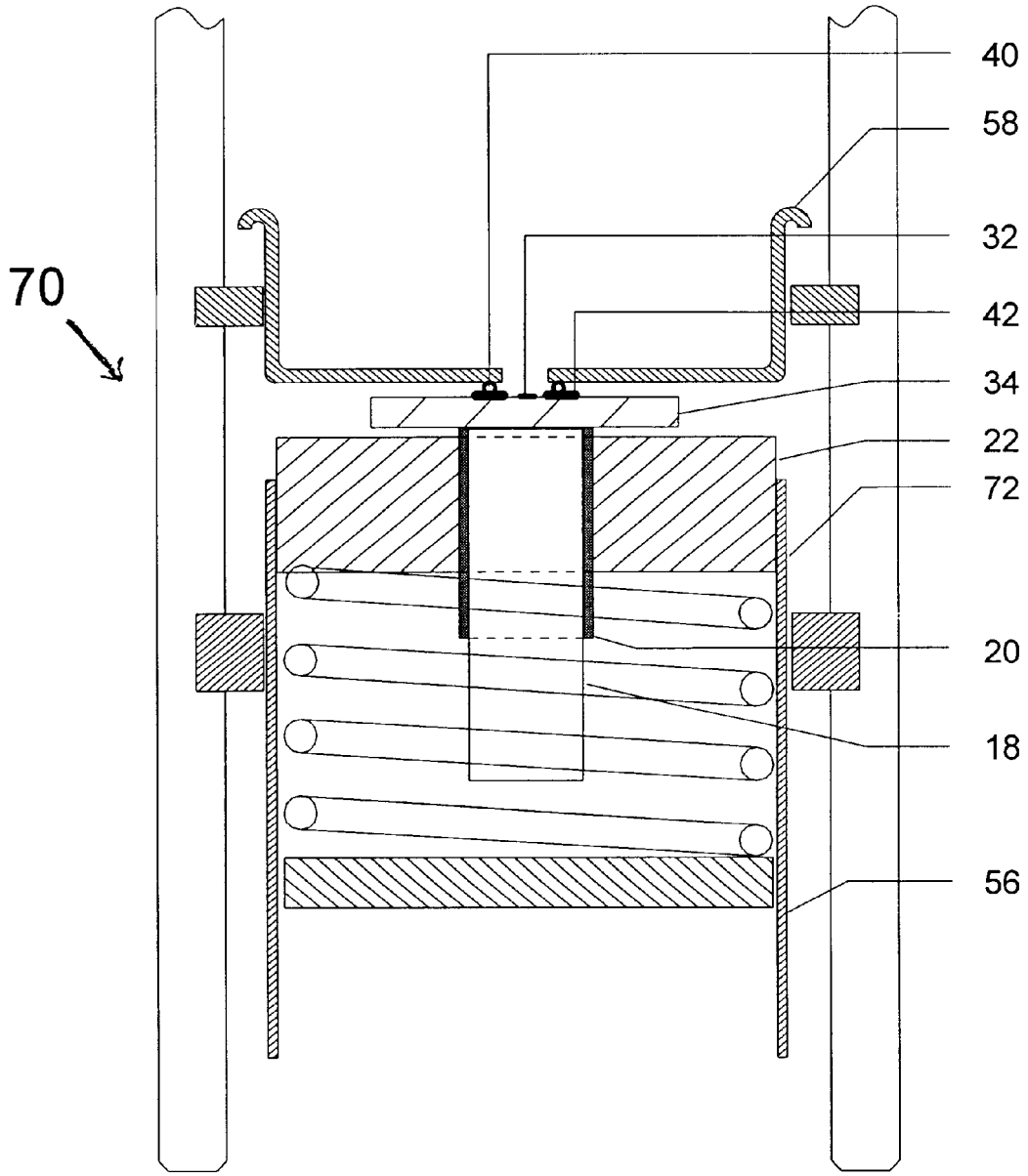
FIG. 5 shows a third embodiment of an electron gun using a field emitting cathode.

FIG. 5 shows a third embodiment of an electron gun for FED cathodes. In this embodiment, shown generally at 70, cold cathode emitting array 32 and substrate 34 are attached to ceramic cathode mount 22. Substrate 34 is bonded directly to cathode ceramic cathode mount 22 using conductive adhesive such as described above. This provides an electrical connection of cold cathode array 32 to metal-ceramic interface ring 20 and subsequently to cathode shank 18. In each of the embodiments (FIGS. 3, 4 and 5), coil spring 54 and retaining spring assembly 56 are inserted into the body of cylinder 52 or 72 behind ceramic cathode mount 22 and retainer spring assembly 56 is welded or otherwise fixed into place. This secures the cathode assembly and provides a consistent force between bumps 40 and the face of cylinder 58. A metal ribbon or wire (not shown) may be welded between shank 18 and all grids and the appropriate stem pins before the electron gun is sealed into a CRT, as is practiced in current methods using electron guns in CRTs. The modified electron gun may then be sealed into a CRT using conventional techniques.

To operate an electron gun with an FED in a finished CRT, gate potential may be applied to the former stem pin for grid 26 (G2) of FIG. 1, which is now electrically connected to cylinder 58, while the former stem pins for grid 24 (G1) and cathode shank 18 of FIG. 1 are connected in common and grounded. Alternatively, the former stem pins for grid 24 and shank 18 may be given a negative bias while the pin for former grid 26 may be grounded. All other electron gun connections may be unchanged. Cathode heaters or filaments are not required for the modified gun. Field emitting cathodes can be used interchangeably with thermionic cathodes without extensive changes to conventional electron gun designs.

A conventional electron gun was modified in accord with the procedures described above to produce the apparatus illustrated in FIG. 3 with a carbon-like field emission array. Referring to FIG. 1, the aperture of grid 24 was enlarged by enough to allow free passage of the modified assembly (or from 0.005 inch to 0.250 inch). Filament 12 was removed. Emissive coating 14 was removed. Ceramic cathode mount 22 was welded to cathode shank 18. Now referring to FIG. 3, field emission array substrate 34 was attached to cathode cap 16 by ABLEBOND 71-1. The substrate and array were carbon-based and formed in accord with procedures described in commonly assigned and co-pending applications cited above. Size and configuration of the contacts were modified to produce the part illustrated in FIG. 2. Ceramic cathode mount 22 was inserted in cylinder 52 and bumps 40 were moved to contact cylinder 58. Then coil spring 54 was inserted in cylinder 52 and retaining spring assembly 56 was inserted and welded in place. Electrical connections were attached to the cathode shank and all electron gun grids and the electron gun was tested in a laboratory vacuum chamber and found to operate satisfactorily.

The foregoing disclosure and description of the invention are explanatory and illustrative thereof, and various changes in the construction and method of operation and assembly may be made without departing from the spirit of the invention.

What is claimed is:

1. An electron gun having a field emission device as a cathode, comprising:

a first hollow elongated body, the body containing a retaining assembly and a spring, the spring disposed so as to apply a force to a cathode mount, the cathode mount being slidably confined in the first elongated body and supporting a shank, the shank supporting a field emission array substrate, the substrate having a field emission array thereon and electrical connection to the first body, the array having an extraction grid, the extraction grid being electrically connected to a plurality of bumps, the bumps being disposed such that the spring causes the bumps to form an electrical connection to a second body, the first and second bodies being adapted for electrical connections to the pins of a cathode ray tube.

2. The electron gun of claim 1 wherein the field emission array is carbon-based.

3. The electron gun of claim 1 wherein the first hollow elongated body is adapted from grid 1 of an electron gun designed for use of thermionic emission.

4. The electron gun of claim 1 wherein the second body is adapted from grid 2 of an electron gun designed for use of thermionic emission.

5. The electron gun of claim 1 wherein the spring is a coil spring.

6. The electron gun of claim 1 further comprising a metal support plate disposed between the shank and the field emission array substrate.

7. An electron gun having a field emission device as a cathode, comprising:

a first hollow elongated body, the body containing a retaining assembly and a spring, the spring disposed so as to apply a force to a cathode mount, the cathode mount being slidably confined in the first elongated body and supporting a field emission array substrate, the substrate having a field emission array thereon and electrical connection to the first body, the array having an extraction grid, the extraction grid being electrically connected to a plurality of bumps, the bumps being disposed such that the spring causes the bumps to form an electrical connection to a second body, the first and second bodies being adapted for electrical connections to the pins of a cathode ray tube.

8. The electron gun of claim 7 wherein the field emission array is carbon-based.

9. The electron gun of claim 7 wherein the first hollow elongated body is adapted from grid 1 of an electron gun designed for use of thermionic emission.

10. The electron gun of claim 7 wherein the second body is adapted from grid 2 of an electron gun designed for use of thermionic emission.

11. The electron gun of claim 7 wherein the spring is a coil spring.

12. A cathode for use in an electron gun, comprising:

a field emission array substrate having a field emission array thereon, the array having emitters and an extraction grid, the extraction grid being spaced apart from the emitters. by an insulating layer therebetween and connected to a gate contact layer; and bumps disposed on the gate contact layer so as to space apart the substrate and a body in electrical contact with the bumps.

13. The cathode of claim 12 wherein the bumps are gold stud bumps.

* * * * *